United States Patent [19]

Fitzpatrick

[11] Patent Number: 4,721,303

[45] Date of Patent: Jan. 26, 1988

[54] CONVERTIBLE MULTI-FUNCTION PHYSICAL EXERCISER

[76] Inventor: Patrick C. Fitzpatrick, P.O. Box 460, Villa Anthela, Camino Del Higueral, Fuentes Es Tanto, San Pedro de Alcantara, Marbella, Spain

[21] Appl. No.: 824,813

[22] Filed: Jan. 31, 1986

[30] Foreign Application Priority Data

Jan. 31, 1985 [GB] United Kingdom ..... 8502646

[51] Int. Cl.[4] ..... A63B 21/00

[52] U.S. Cl. ..... 272/117; 272/134; 272/136; 272/DIG. 4

[58] Field of Search ..... 272/72, 117, 118, 123, 272/134, 136, 142, DIG. 4, 143

[56] References Cited

U.S. PATENT DOCUMENTS

| | | | |
|---|---|---|---|
| 2,356,260 | 8/1944 | Maxwell | 272/143 X |
| 2,977,120 | 3/1961 | Morris . | |
| 3,438,627 | 4/1969 | Lanne . | |
| 3,614,108 | 10/1971 | Garten | 272/143 X |
| 4,195,834 | 4/1980 | Lambert | 272/118 |
| 4,286,782 | 9/1981 | Fuhrhop | 272/117 |
| 4,349,194 | 9/1982 | Lambert, Jr. et al. | 272/118 |
| 4,390,179 | 6/1983 | Szkalak | 272/118 |
| 4,422,636 | 12/1983 | De Angeli | 272/143 X |
| 4,561,651 | 12/1985 | Hole | 272/117 |
| 4,563,003 | 1/1986 | Bugallo et al. | 272/118 |
| 4,600,189 | 7/1986 | Olschansky et al. | 272/118 |
| 4,603,855 | 8/1986 | Sebelle | 272/118 X |
| 4,616,825 | 10/1986 | Anderson | 272/72 X |
| 4,621,807 | 11/1986 | Stramer | 272/117 |

FOREIGN PATENT DOCUMENTS

| | | | |
|---|---|---|---|
| 3417980 | 1/1985 | Fed. Rep. of Germany . | |
| 3202667 | 8/1982 | PCT Int'l Appl. . | |
| 635999 | 12/1978 | U.S.S.R. | 272/134 |

*Primary Examiner*—Richard J. Apley
*Assistant Examiner*—Robert W. Bahr
*Attorney, Agent, or Firm*—Mason, Fenwick & Lawrence

[57] ABSTRACT

A convertible physical exercising device adapted for performing a range of different exercises has a user-engageable movable member connected to a resistance through an elongated flexible element. The flexible element is trained through a final guide which is carried by a pivoted support whose angular position relative to the body of the device can be varied and fixed so as to vary the rest position of the movable member.

23 Claims, 11 Drawing Figures

FIG. 10.
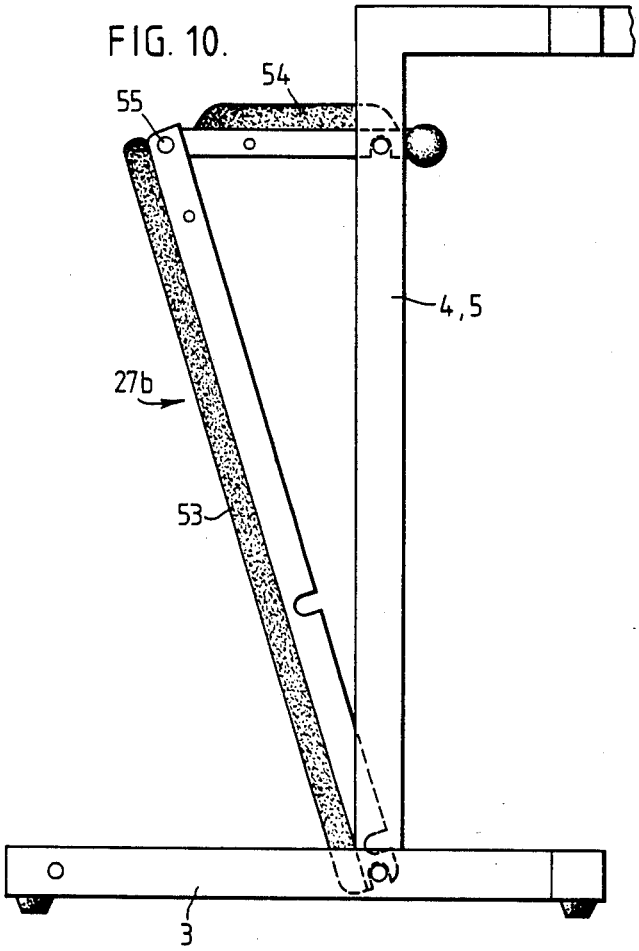
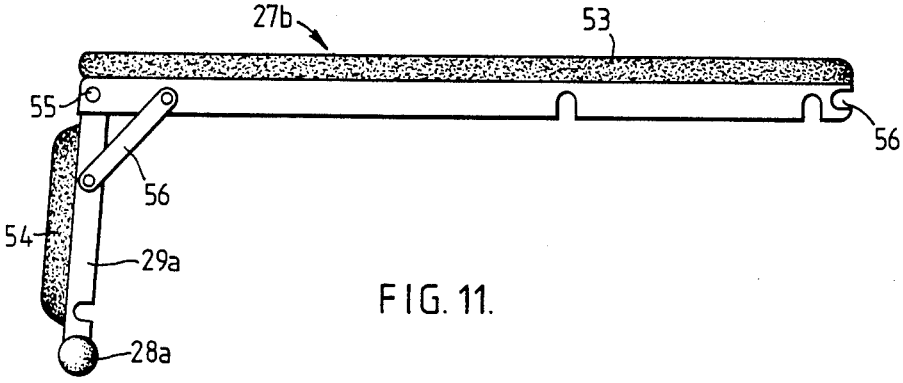
FIG. 11.

CONVERTIBLE MULTI-FUNCTION PHYSICAL EXERCISER

TECHNICAL FIELD

The invention relates to physical exercise devices and more particularly, but not exclusively, to such exercisers primarily intended for domestic use.

BACKGROUND ART

It is particularly in the domestic situation, where space considerations are often important, that there has in recent years been a trend toward so-called "multi-exercisers" on which a variety of different exercises can be performed to provide a balanced program of exercise without the need for many different items of exercising equipment. It is well known that in the institution or gymnasium situation much of the exercising equipment is weight-actuated, that is to say weights provide the resistance used to exercise the various muscle groups. The reason for this is perhaps mainly because weights are simple and reliable. In addition the resistance provided by weights is readily adjustable by adding to, or substracting from, the weights. In the domestic situation weight-actuated exercising devices are less appropriate because of the bulky nature of conventional exercisers employing weights and because such apparatus is not very versatile in the multi-exercise sense without further increasing the physical bulk of the exerciser.

It is among the objects of the invention to provide a physical exerciser which can readily be made to be of low bulk while being convertible to allow the performance of a large range of exercises. It is another object of the invention to provide a low bulk convertible weight actuated exercising device.

DISCLOSURE OF INVENTION

According to the invention there is provided a convertible physical exercising device comprising a body, a movable member on the body and adapted to be engaged and moved by a user, resistance means providing resistance to movement of the movable member, an elongate flexible element operatively coupling the movable member and the resistance means, a final guide over which the elongate flexible element is trained, support means pivotally mounted on the body and supporting the final guide, and securing means on the body for releasably securing the support means in a plurality of different positions relative to body, whereby the position of the final guide on the body can be altered to vary the rest position of the movable member so that the exercising device can be used to perform a range of different exercises. Preferably the resistance means comprises at least one weight. Advantageously the support means is rotatable on the body through substantially 360 degress and means is provided on the body for releasably securing the support means in four substantially normal positions of rotation. The pivotally mounted support means may be an arm pivotally mounted on the body near to one of its ends. The final guide preferably comprises at least one pulley mounted on the arm near to its free end. It is preferred that the final guide comprise a co-operating pair of pulleys between which the elongate flexible element is trained.

An intermediate guide for the elongate flexible element is preferably disposed on the body substantially on the pivotal axis of the arm supporting the final guide and is arranged to surround the elongate flexible element so that it can guide the elongate flexible element irrespective of the attitude on the body of the final guide. The intermediate guide may be in the form of a group of four pulleys or alternatively the intermediate guide may be in the form of an eyelet, the interior of which may if desired be coated or made from a low frictional material. If desired the final guide may be in the form of an eyelet so as to provide universal guidance.

Where the intermediate guide comprises four pulleys they are preferably disposed on a common mounting and arranged in a cross-like configuration with their axes in one plane, the arrangement being such that the peripheries of the neighboring puleys define between the pulleys a closed ring-like guide. Alternatively the pulleys could be arranged in a cross-like configuration but with their peripheries spaced apart, the gaps between the peripheries being substantially filled with spacer members to form a smooth closed ring-like guide. In this way the elongate flexible element which is arranged to pass through the closed ring of pulleys is always guided by one or other of the pulleys irrespective of the disposition of final guide.

If desired a lever may be pivotally mounted on the body at a position adjacent to the pivotal mounting of the arm on the body, a handle being provided on the lever and means for connecting the elongate flexible element to the lever, whereby exercise can be performed by moving the lever against the resistance afforded by the weight. The lever is preferably pivotally mounted on the arm. The pivotal mounting of the arm on the body preferably comprises resilient means whereby the arm can be displaced substantially parallel to the pivot axis of the arm on the body to facilitate the repositioning of the arm relative to the body. Means may be provided on the body for releasably embracing the arm and for locking the arm to the embracing means. The embracing means preferably comprise U-shaped members in which at least a portion of the arm can be snugly received. In a preferred embodiment four U-shaped members are disposed around the pivot axis of the arm in a cross-like configuration. The means for connecting the elongate flexible element to the lever may be adjustable along the lever to vary the effective resistance to movement of the lever afforded by the weight, although the same effect can be achieved with a conventional weight stack.

In a preferred embodiment the exercising device comprises a pair of weights each connected via its own elongate flexible element to its own movable member, each elongate flexible element being trained over its own adjustably mounted final guide. The body may be a frame comprising a pair of mutually spaced upright members each of which carries a pivotally mounted arm having a final guide for an elongate flexible element, the pivot axes of the arms being parallel and in the same horizontal plane whereby the arms can be moved into a position whereby they extend towards one another and the free ends of the arms are adjacently disposed. A seat can be disposed on the body between the pivotal mountings of the arms and in substantially the same plane as the said pivotal mounting. A bench can be disposed on the body between the pivotal mountings of the pair of arms. Additionally or alternatively a user support may be provided on the body substantially at floor lever and arranged to support a user during use of the device.

Another problem with weight-actuated exercises is that because they are essentially heavy they are difficult to move. This problem is solved by providing the body of the inventive exerciser with transport means, e.g., a pair of ground engaging wheels, preferably arranged on the body below the weight means, whereby the exerciser can be tipped onto the transport means and moved in the manner of a wheelbarrow or trolley.

BRIEF DESCRIPTION OF DRAWINGS

The invention is diagrammatically illustrated by way of example of the accompanying drawings, in which:

FIG. 10 is a side elevational view of a convertible user support configured for use as a seat with the exercise device of FIG. 4, and FIG. 11 is a side elevational view of the convertible user support of FIG. 10 and configured for use as a bench.

BEST MODES FOR CARRYING OUT THE INVENTION

Figure 1:
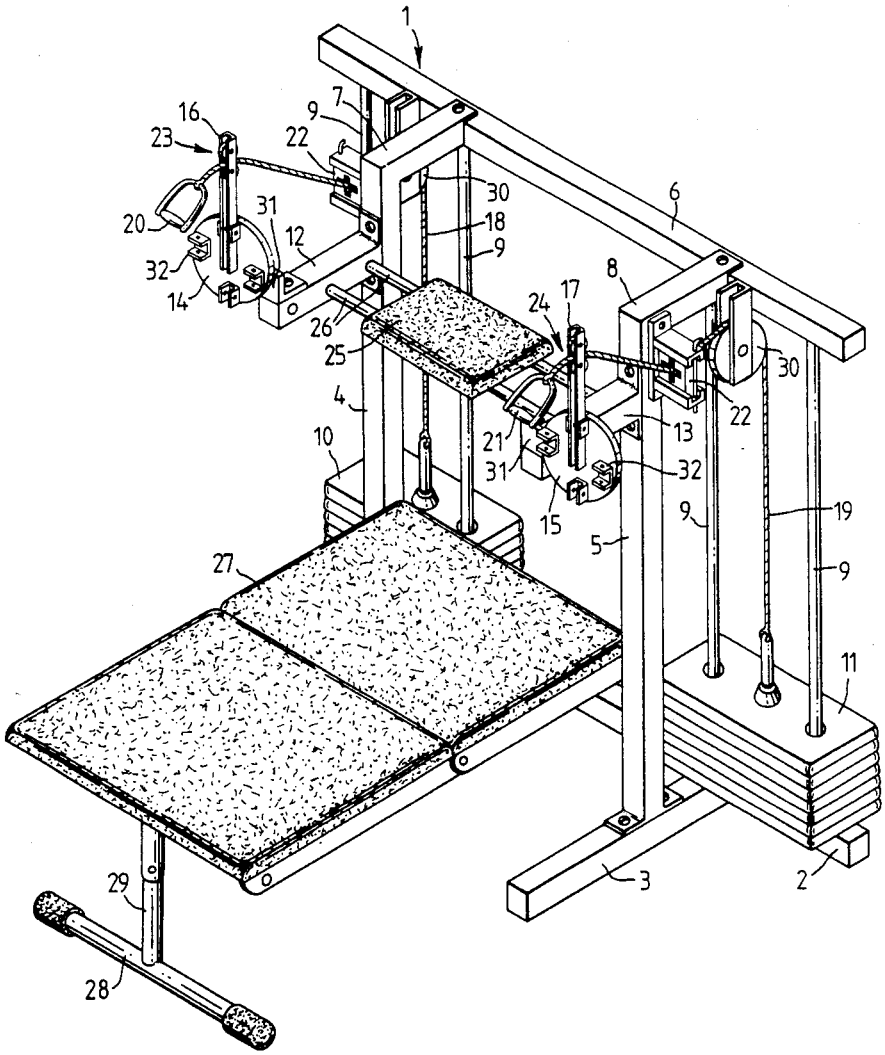
FIG. 1 is a perspective view of one embodiment of weight-actuated physical exercising device according to the invention.

Referring to FIG. 1 of the drawings there is shown a weight actuated physical exercising device comprising a frame 1 made of square section tube united by bolts, although other tube sections are possible and it would of course be possible to weld the frame parts together. The frame 1 comprises a ground engaging portion consisting of a straight rear frame member 2 from which extend forwardly a parallel pair of frame members 3, only one of which can be seen in FIG. 1. The frame members 3 are attaced to the rear frame member 2 at about one quarter of the distance from the respective ends of the frame member 2. At a position intermediate the ends of the members 3 are attached a pair of upright members 4 and 5 respectively which at their upper ends are formed with rearwardly extending horizontal members 7 and 8 respectively. Members 7 and 8 support at their ends a horizontal frame member 6 which is positioned vertically above the rear frame member 2 and which is similar in length to the member 2. Between the vertically superposed frame members 2 and 6 are supported two pairs of tubular guides 9 on which slide a pair of weight stacks 10 and 11 respectively in a manner known per se. The weight stacks 10 and 11 are connected to respective user handles 20 and 21, which are formed as stirrups, by means of elongate flexible elements 18 and 19 respectively which may for example be cables, ropes or cords. Each elongate flexible element is trained over a first guide pulley 30 mounted on the member 6 above the respective weight stacks after which the elongate flexible elements are trained through intermediate guides 22 supported on the upper ends of the upright members 4 and 5 respectively. The intermediate guides are described in more detail below with reference to FIGS. 8 and 9 of the drawings. The elongate flexible members 18 and 19 are then trained over final guides 23, 24 respectively mounted near the free ends of pivoted arms 16 and 17, respectively and which are carried by horizontal forwardly projecting frame members 12 and 13 respectively mounted on the upright frame members 4 and 5, near the tops of the upright frame members.

Figure 6:
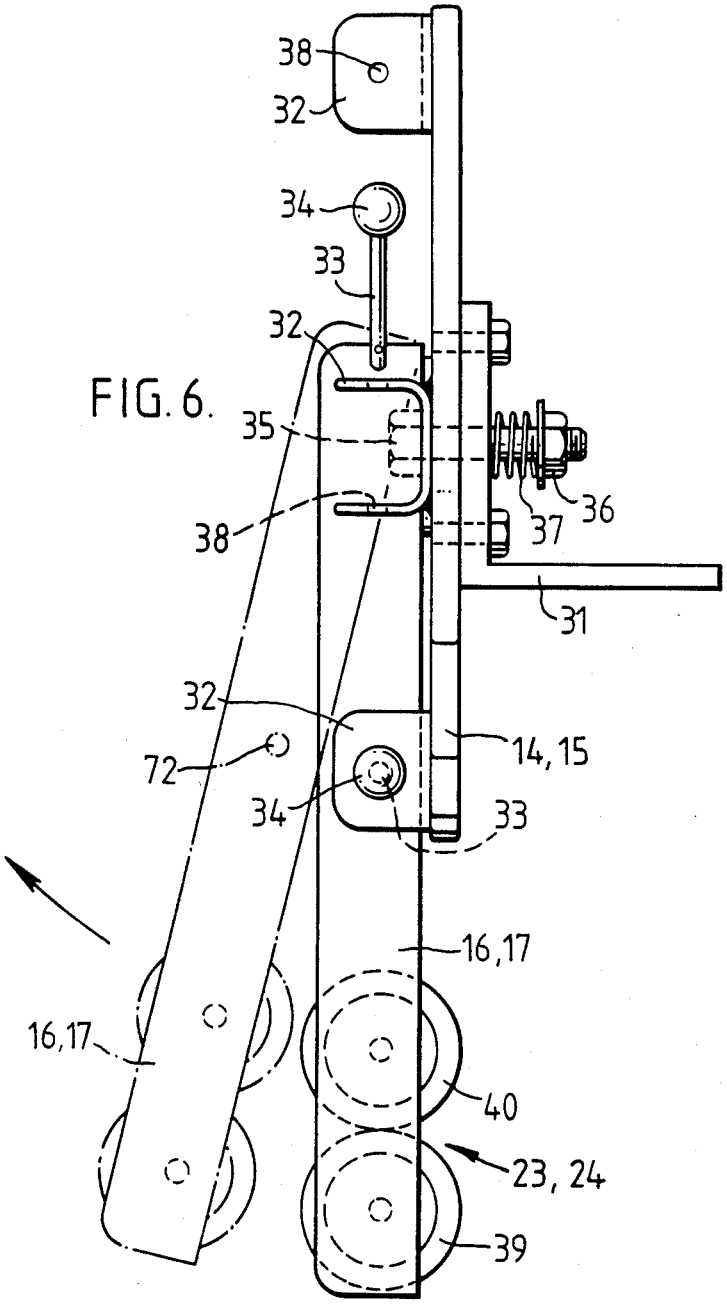
FIG. 6 is a side elevational view of a detail of an exercising device according to the invention and showing the means supporting the final guide.

As can be seen in conjunction with FIG. 6 of the drawings, the arms 16 and 17 are each pivotally attached to the center of generally disc-like plates 14, 15 by means of bolts 35 which pass through the apertures near one end of the arms 16, 17 and through corresponding apertures in the center of plates 14, 15. The bolts are tensioned by means of helical compression springs 37 which surround the shanks of the bolts and by nuts 36 screw threaded on the bolts. By this means the arms 16, 17 are held adjacent to the front faces of the respective plates 14, 15 but can be moved away from the plates through a limited distance against the action of the springs 37. The plates 14, 15 are mounted on angle brackets 31 which in turn are secured to the free ends of the horizontal members 12, 13 of the frame 1.

The free ends of the arms 16, 17 carry guides generally indicated at 23, 24 in the form of pairs of pulleys 39, 40 through which the respective elongate flexible elements are trained. Each arm 16, 17 is in the form of a U-section channel and the pulleys 39, 40 are arranged on axles extending between the opposed flanges of the U-section channel and with the peripheries of the pulleys projecting through slots in the base web of the U-section channel. Each plate 14, 15 carries four U-section members 32 arranged near the periphery of the plate and in a cross-like configuration about its center. The arrangement is such that the arms 16, 17 can be snugly engaged in turn with each of the four U-section members 32 and releasably fixed thereby by means of a pull-pin 33 having a spherical head 34 which passes through a pair of opposed apertures 38 in the limbs in the U-section members 32 and through corresponding apertures 72 in the arms 16, 17. The position of an arm can be changed by withdrawing the pull-pin 33 securing the arm to one of the U-section members 32 after which the arm can be pulled away from the plate against the action of the spring 37, as indicated in dotted lines in FIG. 6, so that the arm is clear of the U-section members 32 after which the arm can be rotated relatively to the plate 14, 15 and re-engaged with any selected one of the U-section members 32. The arm 16, 17 is then fixed in position by repositioning the pull-pin 33. In this way the rest position of the stirrups 20, 21 can be moved between upper and lower positions and between inner and outer positions relative to the exercising device to permit different exercises to the performed with the device.

To facilitate exercise the device is formed with a seat 25 carried on a pair of horizontal frame members 12 and 13 respectively. The device is also provided with a bench 27 the height of which can be adjusted and which can if desired be removed altogether from the device. The bench 27 can be secured to the upright frame members 4 and 5 in any suitable fashion and the free end of the bench is supported by a telescopically adjustable leg 29 the lower end of which carries a transverse ground engaging foot 28.

Figure 8:
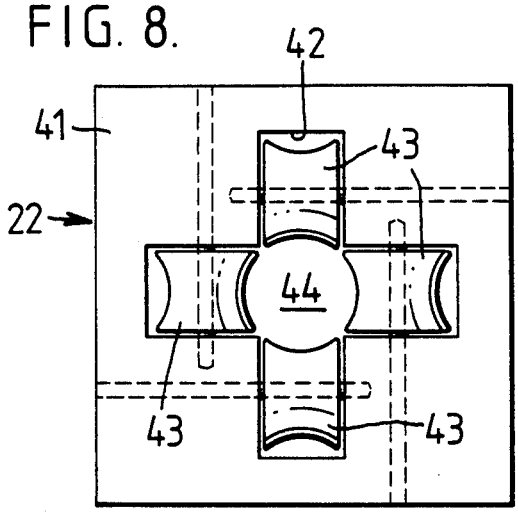
FIG. 8 is a front elevational view of an intermediate guide.

As shown in FIG. 8 of the drawings the intermediate guide 22 comprises a body 41 which is in the form of a rectangular block (e.g., plastics) and which is provided with a through slot 42 of cross-like configuration. Mounted in the limbs of the slot 42 are four guide pulleys 43 which together define a circular aperture 44 in which the elongate flexible element is guided. The arrangement is such that the elongate flexible element is fulley supported and guided no matter which direction it takes relative to the intermediate guide.

Figure 9:
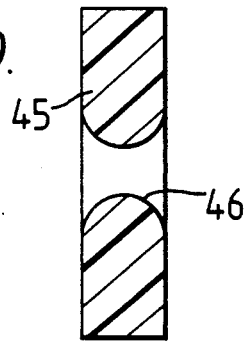
FIG. 9 is a sectional side elevation of an alternative form of intermediate guide.

A similar effect can be achieved in more simple fashion by the eyelet 45 shown in FIG. 9 of the drawings. The eyelet will preferably be made from or coated with a low friction material, at least in the portion 46 of its interior surface which will be contacted in use by the elongate flexible element.

Figure 3:
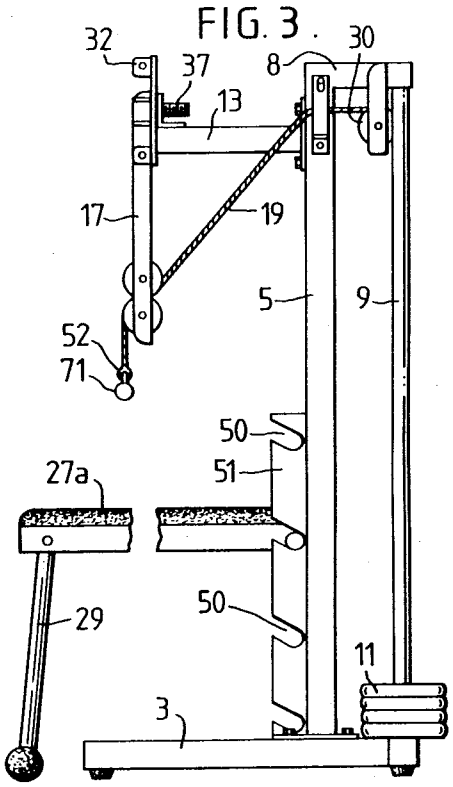
FIG. 3 is a side elevational view of the exercising device of FIG. 2.
Figure 2:
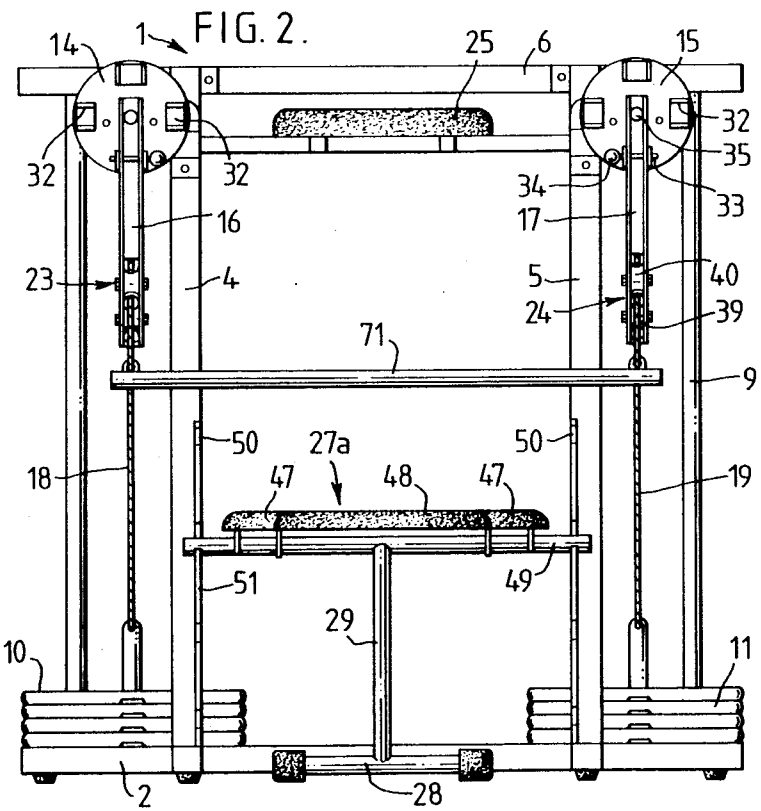
FIG. 2 is a front elevational view of a physical exercising device generally similar to that of FIG. 1.

The exercising device shown in FIGS. 2 and 3 of the drawings is very similar to that described above with reference to FIG. 1 of the drawings Accordingly, like reference numerals are used to denote corresponding parts in the two embodiments. It will be noted however that the bench 27*a* has a wide portion 47 towards its rear and a narrow portion 48 towards it front so that the user can straddle the bench in comfort during exercise. It will also be noted that the bench 27*a* can be adjusted in height by unclipping and respositioning a transverse bar 49 secured to the undersurface of the rear of the bench from a series of corresponding slots 50 in vertical members 51 secured to the upright frame members 4 and 5 respectively. Although not specifically shown in the drawing the leg 29 which supports the free end of the bench can be made to be telescopically adjustable to suit the particular chosen height of the bench.

It will also be noted that in the configuration shown in FIGS. 2 and 3 of the drawings the arms 16, 17 have been moved into their lower, or 6 o'clock, position and that an exercise bar 71 has been secured to the pair of elongate flexible elements 18 and 19 respectively. The ends of the elongate flexible elements remote from the weight stacks 10 are 11 are preferably provided with quick release fasteners 52 of a kind known per se so that when desired the exercise bar 71 may be detached from the elongate flexible members and replaced by other user handles such as the stirrups 20, 21 shown in FIG. 1 of the drawings, or ankle straps or the like.

Figure 4:
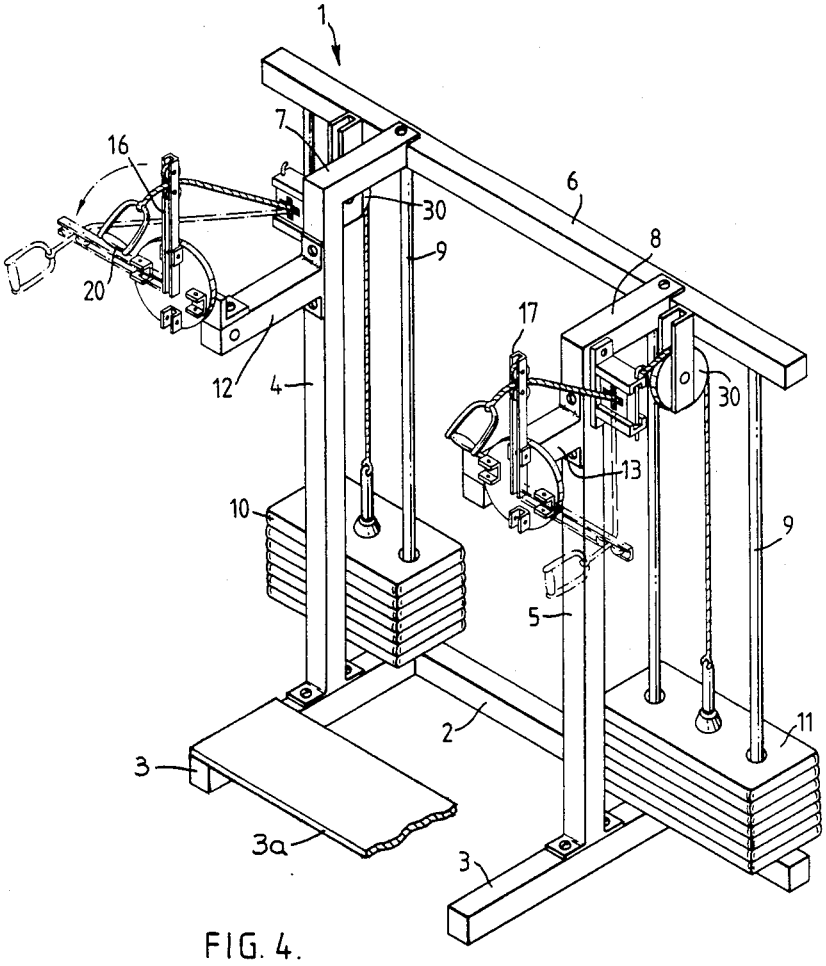
FIG. 4 is a perspective view of another embodiment of exercising device according to the invention.

The exercise device shown in FIG. 4 of the drawings is again generally similar to those described above with reference to FIGS. 1 to 3 (like reference numerals again being used), but in this embodiment the fixed seat 25 has been omitted so that a user may if desired position himself during exercise between the horizontal frame members 12 and 13 respectively. A user support 3*a* (shown partly broken away) may be arranged on the frame members 3 and on which the user can stand during exercise. For use in connection with this embodiment a convertible user support of the kind shown in FIGS. 10 and 11 of the drawings is preferred so that the user may also sit or lie down to exercise. This user support comprises a long bench 53 and a seat 54 on its support leg 29*a*, which leg is pivotally secured to the undersurface or frame of the bench at 55. A strap 56 is releasably secured between the leg 29*a* and the undersurface of the bench to lock the leg in position when the bench 53 is used, as shown in FIG. 11 of the drawings. Alternatively, however, the convertible user support may be used in the position shown in FIG. 10 of the drawings in which the seat 54 is horizontally disposed, in which position the bench portion 53 forms a leg supported on the frame of the exercise device by means of suitable pegs or the like on the frame and which engage in U-shaped cutouts 56 in the end of the bench. In this position the seat 54 takes up an attitude similar to that of the seat 25 in the embodiment of FIG. 1.

Figure 5:
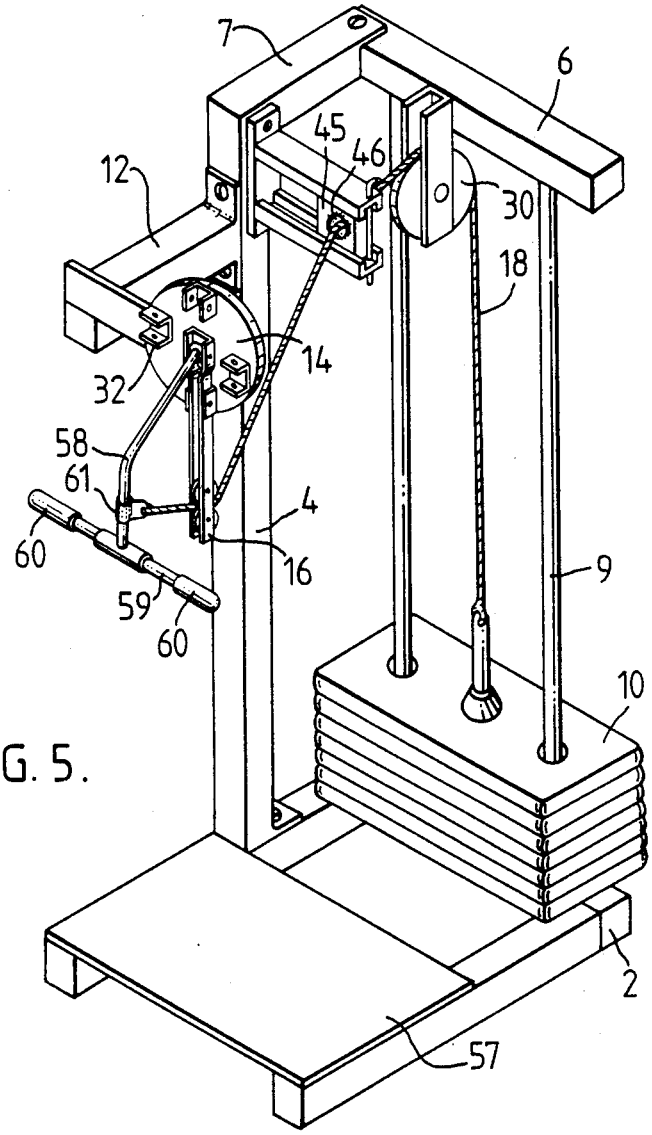
FIG. 5 is a perspective view of yet another embodiment of exercising device according to the invention.

The exercising device of FIG. 5 differs from those described above in that a single assembly of weight stack 10, arm 16 and final guide 23 is provided. The exerciser is also provided with a user support 57 mounted on the frame substantially at ground level and on which the user can be supported during use of the device.

Figure 7:
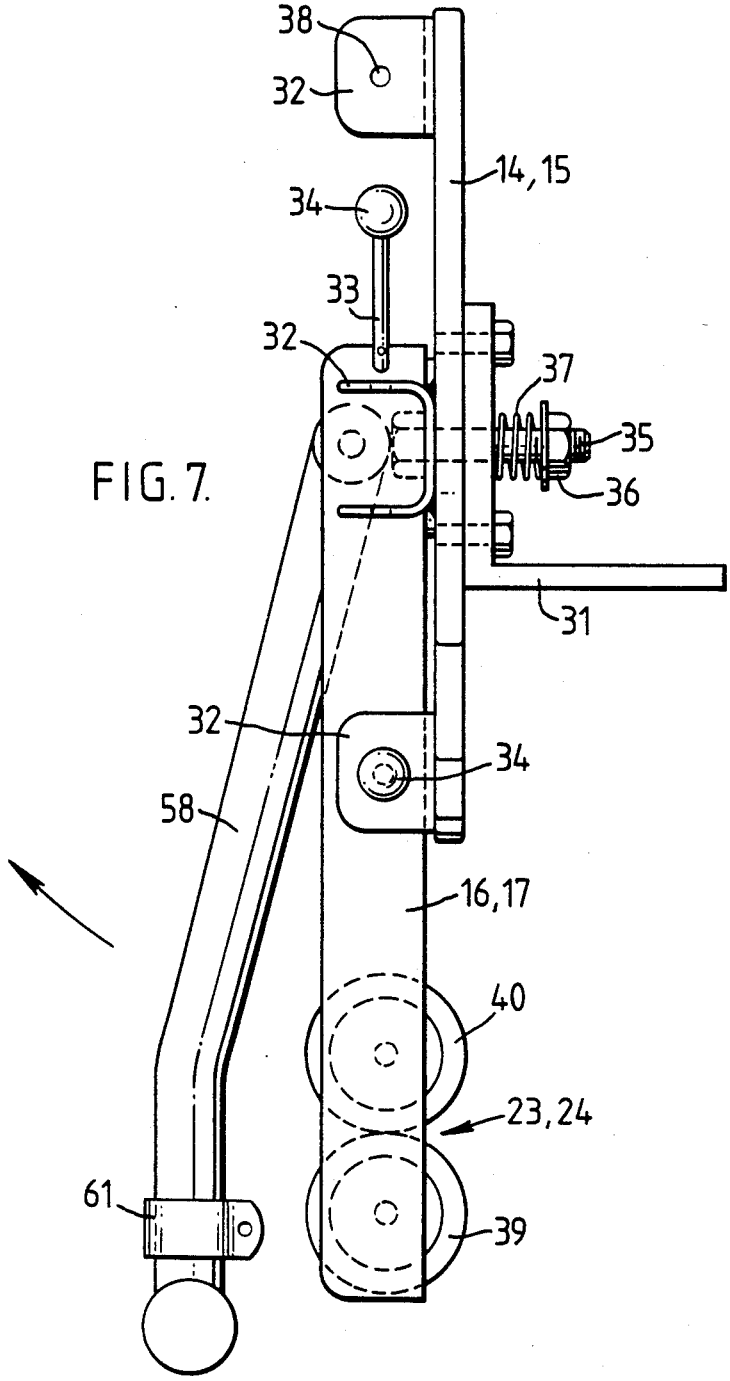
FIG. 7 is a side elevational view, generally similar to FIG. 6, of a modified form of the detail.

In addition a lever 58 is pivotally mounted on the arm 16 at a position close to the pivotal mounting of the arm on the plate 14. This arrangement is also illustrated in FIG. 7 of the drawings. The pivot axes of the lever 58 and the arm 16 are arranged at right angles. The free end of the lever 58 is formed with a cross bar 59 having a pair of user handles 60 at its free ends. The lever is also provided with a tag 61 to which the end of the elongate flexible element 18 can be secured so that exercise can be performed by pivoting the lever 58 against the action of the weight stack 10. The position of the tag 61 on the lever 58 can be adjustable in a manner known per se along the lever whereby the effective effortlever provided the by weight stack can be adjusted as desired, although such adjustment can also be performed by selecting the number of weights in use in the weight stack in conventional fashion. Preferably the lever 58 is removable from the arm 16 in simple fashion so that, for example, a stirrup of the kind shown by reference 20 in FIG. 1 of the drawings can instead be attached to the elongate flexible element. Thus for example the lever 58 may be pivoted in the arm 16 on a releasable pull-pin of the kind referenced 33 in FIG. 6.

It will readily be appreciated that the exercise devices of FIGS. 1 to 4 can readily be adapted to employ levers of the kind indicated by reference 58 in FIGS. 5 and 7, and as indicated above it is preferred that any such levers are detachable to increase the versatility of the devices.

Also it will be appreciated that although it is preferred that the arms carrying the final guides have four positions of use, it would be a simple expedient to increase or decrease the number of use positions for example to three or to eight. Indeed it would be possible to employ clamping means which would make the positioning of the arm infinitely variable.

INDUSTRIAL APPLICABILITY

Thus in the various embodiments of exercise device described above, exercise can be performed with the arms 16, 17 in their various positions so that the stirrups 20, 21 or the like user handles can be moved upwards, downwards or sideways together or in opposition to exercise, from the various different starting positions and while the user is standing, sitting or reclining, whereby the user can undertake a comprehensive exercise program.

I claim:

1. A convertible physical exercising device comprising a body, a movable member on the body and adapted to be engaged and moved by a user from a rest position, resistance means providing resistance to movement of the movable member, an elongate flexible element operatively coupling the movable member and the resistance means so that resistance force is exerted on said movable member through said elongate flexible element, a final guide over which the elongate flexible element is trained, support means supporting the final guide which support means is pivotally mounted on the body for movement in an arc about a substantially horizontal axis for permitting the support means to be positioned in a plurality of different angular positions relative to the body, whereby the position of the final guide on the body can be adjusted to vary the rest position of the movable member to permit the movable member to be moved in various different planes from its various rest positions to vary the direction of force exerted by the elongate flexible element on the movable member so that the exercising device can be used to perform a range of different exercises.

2. A convertible physical exercising device according to claim 1, wherein the resistance means comprises at least one weight.

3. A convertible physical exercising device according to claim 1, additionally including securing means on the body for releasably securing the support means in the plurality of different angular positions relative to the body and wherein the support means is rotatable on the body through substantially 360 degrees and said securing means releasably secures the support means in any one of four substantially normal positions of rotation.

4. A convertible physical exercising device according to either of claims 1 or 2, additionally including securing means on the body for releasably securing the support means in the plurality of different angular positions relative to the body and wherein the support means comprises an arm pivotally mounted on the body near to one of its ends.

5. A convertible physical exercise device according to claim 4, wherein the final guide comprises at lest one pulley mounted on the arm near to its free end.

6. A convertible physical exercising device according to claim 5, wherein the final guide comprises a cooperating pair of pulleys on the arm and between which the elongate flexible element is trained.

7. A convertible physical exercising device according to claim 4, comprising a lever pivotally mounted on the body at a position adjacent to the pivotal mounting of the arm on the body, a handle on the lever and means for connecting the elongate flexible element to the lever.

8. A convertible physical exercising device according to claim 7, wherein the means for connecting the elongate flexible element to the lever is adjustable along the lever to vary the effective resistance to movement of the lever afforded by the resistance means.

9. A convertible physical exercising device according to claim 8, wherein the lever is removably secured to the body.

10. A convertible physical exercising device according to claim 7, wherein the lever is pivotally mounted on the arm with its pivot axis substantially normal to the pivot axis of the arm on the body.

11. A convertible physical exercising device according to claim 10, wherein the pivot axis of the lever is intersected by the pivot axis of the arm on the body.

12. A convertible physical exercising device according to claim 4, wherein the pivot mounting of the arm on the body comprises resilient means whereby the arm can be displaced substantially axially of its pivotal mounting on the body.

13. A convertible physical exercising device according to claim 12, wherein said securing means comprises means on the body for releasably embracing the arm and means for locking the arm to the embracing means.

14. A convertible physical exercising device according to claim 13, wherein the embracing means comprises a U-shaped member for each arm position in which at least a portion of the arm is snugly received.

15. A convertible physical exercising device according to claim 14, comprising a set of four U-shaped members disposed around the pivot axis of the arm in a cross-like configuration.

16. A convertible physical exercising device according to claim 1, comprising two movable members each connected via an elongate flexible element to respective resistance means, the elongate flexible elements being trained over respective final guides.

17. A convertible physical exercising device according to claim 16, wherein the body is a frame comprising a pair of mutally spaced upright members each of which carries support means in the form of a pivotally mounted arm carrying a final guide for one of the elongate flexible elements, the pivot axes of the arms being parallel and in the same horizontal plane whereby the arms can be arranged in a position wherein they extend towards one another and the free ends of the arms are adjacently disposed.

18. A convertible physical exercising device according to claim 17, comprising a seat disposed on the frame between the pivotal mounting of the arm and in substantially the same plane as the said pivotal mounting.

19. A convertible physical exercising device according to claim 17 or claim 18, comprising a bench disposed on the body between the pivotal mounting of the pair of arms.

20. A convertible physical exercising device according to claim 19, wherein said bench comprises a convertible user support having a bench portion and a seat portion arranged for disposition on the body in two substantially normal positions.

21. A convertible physical exercising device according to claim 20, comprising a user support on the body substantially at floor lever and arranged to support a user during use of the device.

22. A convertible physical exercising device according to claim 1 or claim 17, comprising an intermediate guide for the elongate flexible element disposed on the body substantially on the pivotal axis of the support means arranged to surround the elongage flexible element so that it can guide the elongage flexible element irrespective of the position on the body of the final guide.

23. A convertible physical exercising device comprising a frame formed with a spaced pair of upright members, a pair of movable members operatively associated with the frame and adapted to be engaged and moved by a user from a rest position, a pair of weights one being operatively associated with each movable member and providing resistance to movement of the movable member, an elongate flexible element operatively coupling each movable member with a respective one of the weights, an arm pivotally mounted on each upright member, a pair of final guides for the respective elongate flexible elements on the respective arms, means adjustably securing the respective arms in a plurality of different angular positions in an arc about a substantially horizontal axis relative to the frame to vary the rest positions of the movable members, and a pair of intermediate guides one being associated with each respective elongate flexible element, the intermediate guides being arranged to surround the respective elongate flexible elements to provide guidance irrespective of the position of the final guides on the frame, the intermediate guides being disposed substantially on one of the respective pivotal axes of the arms.

* * * * *